US006500197B1

(12) United States Patent
Buesselmann

(10) Patent No.: US 6,500,197 B1
(45) Date of Patent: Dec. 31, 2002

(54) FULL-BODY ATOMISED BATH AND METHOD FOR PROVIDING A FULL BODY ATOMISED BATH

(75) Inventor: Manfred Buesselmann, Larnaca (CY)

(73) Assignee: Vitasalin AG, Munich (DE)

( * ) Notice: Subject to any disclaimer, the term of this patent is extended or adjusted under 35 U.S.C. 154(b) by 0 days.

(21) Appl. No.: 09/869,320

(22) PCT Filed: Dec. 16, 1999

(86) PCT No.: PCT/EP99/10024

§ 371 (c)(1),
(2), (4) Date: Jul. 24, 2001

(87) PCT Pub. No.: WO00/44331

PCT Pub. Date: Aug. 3, 2000

(30) Foreign Application Priority Data

Jan. 28, 1999 (DE) ..... 199 03 377

(51) Int. Cl.[7] ..... A61H 33/02
(52) U.S. Cl. ..... 607/83; 4/524
(58) Field of Search ..... 607/80–84; D24/110; 4/524

(56) References Cited

U.S. PATENT DOCUMENTS 3,854,662 A 12/1974 Janson
4,130,120 A 12/1978 Kohler, Jr.
4,424,598 A * 1/1984 Cima ..... 4/524
4,862,526 A * 9/1989 Berger ..... 4/525
5,664,593 A * 9/1997 McClain ..... 119/604

FOREIGN PATENT DOCUMENTS

| | | |
|---|---|---|
| DE | 39 26 035 | 2/1991 |
| EP | 0 300 577 | 1/1989 |
| EP | 0 377 174 | 7/1990 |

* cited by examiner

*Primary Examiner*—Linda C. M. Dvorak
*Assistant Examiner*—Henry M. Johnson, III
(74) *Attorney, Agent, or Firm*—Oblon, Spivak, McClelland, Maier & Neustadt, P.C.

(57) ABSTRACT

A method for administering a full-body mist bath, as well as a full-body mist-bath unit, having a bathing cubicle for accommodating at least one person and atomized liquid. A liquid atomizer is provided with a high-pressure chamber in which the liquid is compressed by the action of a high pressure to prepare the atomized liquid. A nozzle is provided for explosive ejection of the compressed liquid subjected to high pressure, so that it bursts apart into small particles. In the process, the particles become positively charged and their photon emission is increased.

15 Claims, 3 Drawing Sheets

FULL-BODY ATOMISED BATH AND METHOD FOR PROVIDING A FULL BODY ATOMISED BATH

In a standard steam bath, steam is fed continuously into a bathing cubicle. Thereby the air in the bathing cubicle is saturated with steam. Part of the steam condenses to water in the form of finely dispersed droplets. Because of the heat of the introduced steam, a relatively high temperature of approximately 40° C. to 60° C. prevails in the bathing cubicle.

When a person occupies the bathing cubicle, his or her blood flow and transpiration are increased. This leads to rapid water losses ("cleansing") and, by virtue of the absence of evaporation, to heat accumulation that influences the metabolism and circulation. This must be dissipated by subsequent cooling under a temperature-controlled shower or in a cold-water pool.

Compared with the steam bath, the temperature is even higher in a sauna bath. Dry heat at approximately 85° C. to 95° C. usually prevails in its bathing cubicle. The high temperature stimulates the blood flow and thus also the metabolism.

These effects can be intensified by pouring water (infusion) over heated stones in the hot-air cubicle and thereby generating steam. In many cases, healing herbs, ethereal oils, etc. are additionally present in the infusion water and thus also in the generated steam. Similar conditions can also be achieved for the already mentioned steam fed to the bathing cubicle of the steam bath.

The usual sauna and steam baths, however, suffer from the disadvantage among others that the circulation of the bather is severely stressed by the high temperature in the bathing cubicle.

In Patent Abstracts of Japan C-853, Jul. 25, 1991, Vol. 15/No. 293, there is disclosed a mist bath into which an atomized liquid is fed.

To produce the mist, the liquid is forced through small apertures of a nozzle, thus becoming atomized.

Patent Abstracts of Japan, 09154913 A, Jun. 17, 1997, cited in opposition, discloses a steam bath into which relatively hot steam is supposed to be fed. For this purpose, hot water is forced by a pump through small apertures of a spray nozzle. Hereby the hot water is atomized. The spray nozzles can be closed by a cover whenever hot water is not supposed to be supplied.

In Patent Abstracts of Japan, C-1125, Oct. 28, 1993, Vol. 17/No. 591, there is described a steam sauna in which an atomized liquid is fed into a sauna room. In the process, liquid is fed via a pump to a spray nozzle, where it is forced through small apertures, thus atomizing the liquid.

In German Patent DE 4228229 C1, cited in opposition, there is described a method and a means for generating mist. For this purpose a liquid is excited into oscillations in an atomizer vessel by means of a quartz oscillator, so that a cloud of liquid droplets is produced.

The object of the invention is to provide a different type of unit and a different type of method for administering a full-body bath, while creating numerous advantages.

It achieves this object with a full-body mist-bath unit having a bathing cubicle for accommodating at least one person and atomized liquid, and having, for preparation of the atomized liquid, a liquid atomizer, which is provided with a high-pressure chamber in which the liquid is compressed by the action of a high pressure of at least 100 bar, and with a nozzle for explosive ejection of the compressed liquid subjected to high pressure, so that it bursts apart into small particles by virtue of its high internal pressure (claim 1).

The invention also achieves the aforesaid object by a method for administering a full-body mist bath to at least one person in a bathing cubicle, with the following steps: compression of a liquid by the action of a high pressure of at least 100 bar on the liquid; explosive ejection of the liquid, so that it bursts apart into small particles by virtue of its high internal pressure; supplying the atomized liquid to the bathing cubicle.

Thus the skin of the bather is not exposed to hot air containing hot steam, as it would be in the standard steam and sauna baths. Instead, an atomized liquid acts thereon. In contrast to sauna and steam baths, therefore, a much lower temperature can prevail in the bathing cubicle, especially a temperature lower than 35° C., and especially preferably of 22 to 28° C. Therewith less stress is imposed on the circulation of the bather than is the case in sauna or steam baths.

In an advantageous embodiment in this connection, the entire body, or in other words all of the skin of the bather is exposed to the mist particles, corresponding to a "full bath" in the sauna. Another option, as in a "partial bath" in the sauna, is a treatment of the entire body except for individual body parts (such as the head, trunk together with legs, etc.).

According to the inventive unit and the inventive method, the liquid is so strongly compressed that its volume is decreased. For liquids, this is generally achieved only at very high pressures. The compressed liquid is then discharged into the normal atmosphere of, for example, 1 bar. In the process, the liquid bursts apart into minute particles by virtue of its high internal pressure, or in other words it explodes in all directions to form a fine mist.

Preferably the liquid to be atomized is water (claims 2, 10). Advantageously, an oil can also be used as the liquid to be atomized, especially an organic oil (claims 4, 12), for example peanut oil. During inventive atomization of the oil, it is excited to increased emission of photons as a result of the high pressure applied and of the subsequent bursting apart into small mist particles. Through the action of the mist particles excited in this way, for example on the skin of the person in the bathing cubicle, biophoton emission is increased in that person. "Biophotons" are to be understood as the light quanta of the (weak) radiation emitted by the cells of the person. The emission intensity can be determined, for example, by using a photomultiplier to measure the light emitted from a blood sample of the person.

In an especially preferred embodiment, the full-body mist bath is administered for 10 to 30 minutes (claim 13). The biophoton emission of the blood of the person is then increased by more than 20% relative to the initial condition immediately after the full-body bath, and subsequently it decreases linearly back to the original emission intensity. Thereby a durable therapeutic effect is achieved in the bather.

In an especially preferred embodiment, additional salts have been mixed with the water (claims 3, 11), especially Dead Sea salts. The water is preferably saturated with salts, or is close to the saturation point. After atomization of the water, the salts are then contained in the mist particles as well, and so can act on the skin of the person in the bathing cubicle. In this way skin diseases can be treated without necessitating a stay at a health resort close to a sea with high salt content (Baltic Sea, Dead Sea, etc.). The salty mist particles have a toning effect even on healthy skin.

Preferably the water may also be enriched with vitamins instead of or in addition to the salt. Analogously, in an especially preferred embodiment, vitamins are also contained in the oil that can be used instead of water as the liquid to be atomized. Advantageously, medications may also be dissolved in the liquid to be atomized.

Preferably the bathing cubicle can be sealed such that it is airtight to the exterior (claim 5). This ensures that the generated mist particles do not escape outward from the bathing cubicle. These happen to be positively charged during the inventive atomization of the liquid. Consequently, the mist particles repel one another, and so—without sealing—they rapidly diffuse out of the bathing cubicle.

In an advantageous embodiment, a UV source is provided in the bathing cubicle (claim 6). Thereby the person's skin is exposed to ultraviolet radiation during bathing. This has the result that the advantageous effects of the mist particles on the skin as described in the foregoing are further intensified.

In a further preferred embodiment, a shower is provided in the bathing cubicle (claim 7). Thus the body can be washed after bathing. In the process, it is possible, for example, to rinse off salt residues remaining on the skin.

In a particularly preferred d embodiment, a fan is provided in the bathing cubicle, especially in a tube of the bathing cubicle into which the liquid is ejected (claim 8) Therewith it is possible, for example, to disperse the mist particles in the bathing cubicle or, for example, to boost the supply of atomized liquid to the bathing cubicle.

In the high-pressure chamber, the liquid is subjected to a pressure of preferably at least 100 bar, especially of higher than 150 bar. In particular, the pressure ranges between 200 and 800 bar. Thereby it is ensured that, during explosive ejection of the liquid from the nozzle into the normal atmosphere, it bursts apart into small mist particles. These have a size of about 0.5 to 10 $\mu m^3$, preferably approximately 1 $\mu m^3$. Thus one $mm^3$ of liquid bursts apart into one billion particles. In contrast, if the liquid were at too low a pressure, it would emerge from the nozzle as a closed jet.

In an advantageous embodiment, between 0.01 and 0.5 ml of liquid, especially approximately 0.05 ml, is ejected through the nozzle in each case (claim 14). In a particularly preferred embodiment, the liquid is ejected into a tube and supplied via the tube to the bathing cubicle (claim 15).

The invention will now be explained in more detail on the basis of a practical example and of the attached drawing, wherein.

Figure 1:
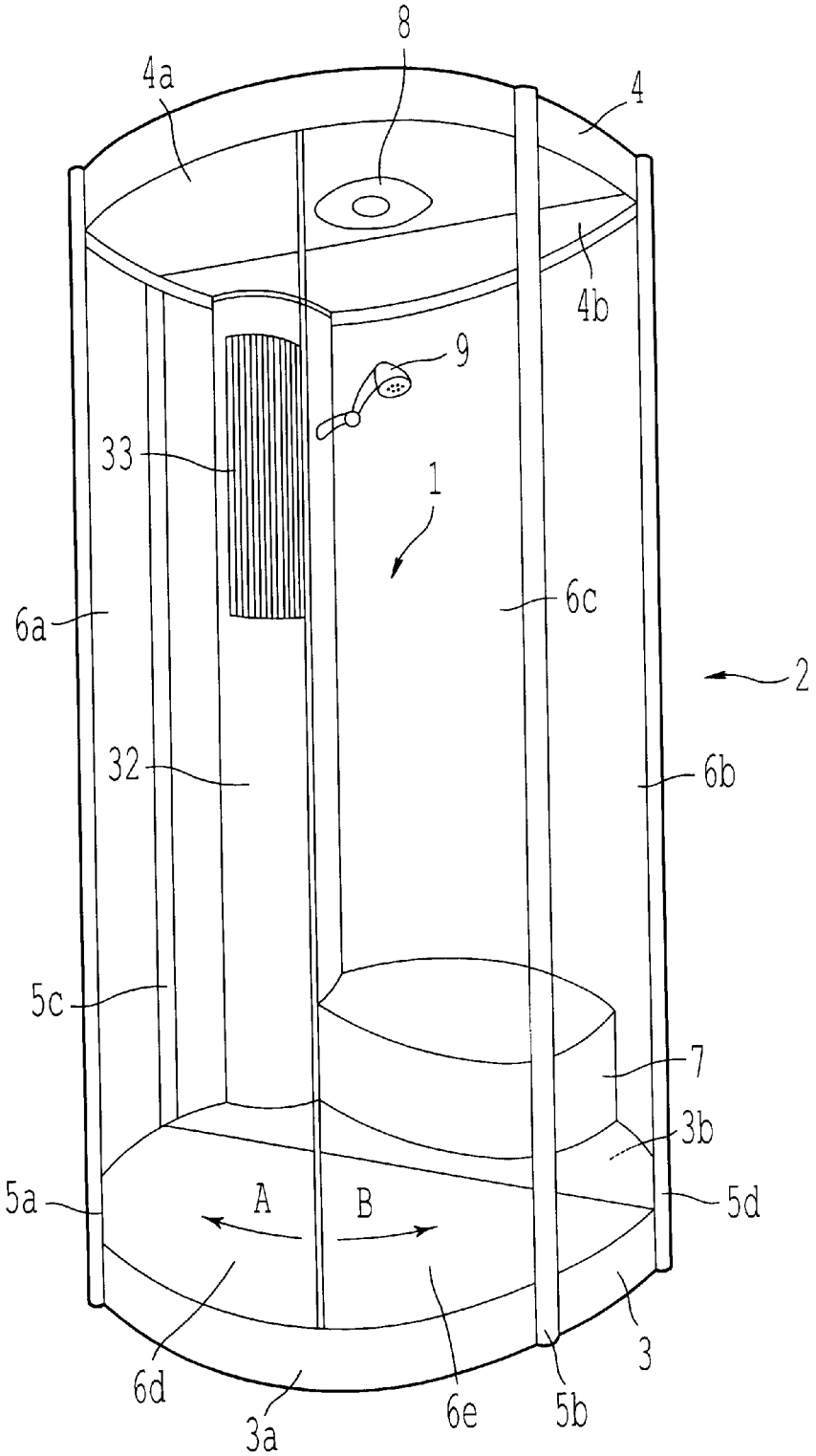
FIG. 1 shows a perspective view of a mist-bath unit according to the present invention from the front right.

According to FIG. 1, a mist bath 2 is provided with a bottom plate 3 and a top plate 4, each of which have substantially circular cross section. The upper ends of two front support tubes 5*a, b* and of two rear support tubes 5*c, d* are each fastened to a side wall of bottom plate 3, and the lower ends of support tubes 5*a, b, c, d* are each fastened to a side wall of top plate 4. Between each of front tubes 5*a, b* and the corresponding rear support tube 5*c, d* disposed therebehind there extends from bottom plate 3 to top plate 4 a right and a left side panel 6*a, b* respectively of acrylic glass. Correspondingly, a rear panel 6*c* extends between the two rear support tubes 5*c, d* from bottom plate 3 to top plate 4. This is also made of acrylic glass. Between front support tubes 5*a, b*, bottom plate 3 and top plate 4 there are provided a left and a right front panel 6*d, e*. These are each displaceable transversely relative to front support tubes 5*a, b* and, in the undisplaced position shown in FIG. 1, they directly adjoin one another via appropriate sealing lips (not illustrated). A bathing cubicle 1 formed between top plate 4, bottom plate 3 and panels 6*a, b, c, d, e* is then airtight to the exterior.

Figure 3:
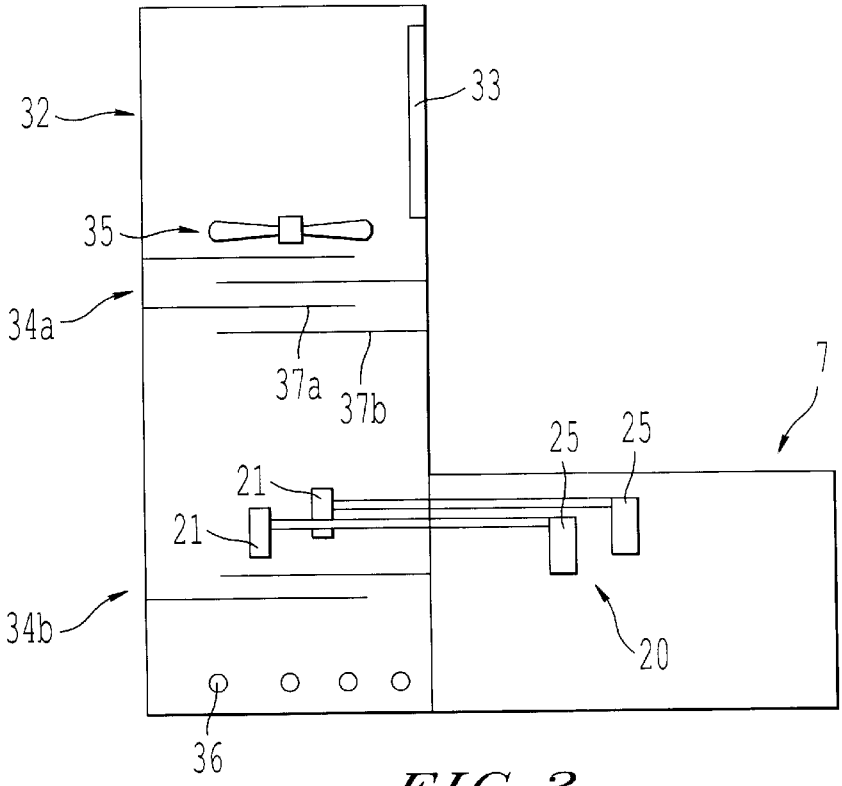
FIG. 3 shows a schematic cross-sectional view of the tube and of the bench of the mist-bath unit.

Inside bathing cubicle 1, a tube 32 extends between bottom plate 3 and top plate 4. Thereon there is disposed a shower 9. In addition, a watertight bench 7 is disposed on one upper side of bottom plate 3. A UV source 8 is provided on one lower side of top plate 4. Top plate 4 can be separated into a front top-plate section 4*a* and a rear top-plate section 4*b*, and bottom plate 3 into a front bottom-plate section 3*a* and a rear bottom-plate section 3*b*. In this way mist bath 2 as a whole can be separated into a front and a rear part. The front part is then provided with front top-plate section 4*a* with UV source 8, front bottom-plate section 3*a*, front panels 6*d, e*, front support tubes 5*a, b* and side panels 6*a, b*. The rear part is provided with rear top-plate section 4*b*, rear bottom-plate section 3*b*, rear support tubes 5*c*, 5*d*, rear panel 6*c*, tube 32 and bench 7. In this way, as illustrated in FIG. 3, the essential technically complex devices for generating and distributing mist are mounted in tube 32 and in bench 7, specifically two atomizers 20, two sound absorbers 34*a*, 34*b* and one fan 35 (see hereinafter). Thus the technically complex devices are preassembled in the rear part of mist bath 2; these devices do not have to be assembled separately at the point of use of mist bath 2. Instead, the only necessary task there is to join the rear part of mist bath 2 to its front part.

If right front panel 6*e* according to FIG. 1 is shifted toward the right rear in the direction of arrow B, transversely relative to right front support tube 5*b*, and left front panel 6*d* is shifted toward the left rear in the direction of arrow A, transversely relative to left front support tube 5*b*, such that they are disposed behind right or left side panel 6*b*, 6*a* respectively, a person can step into bathing cubicle 1 and occupy bench 7. Thereupon bathing cubicle 1 is sealed once again by displacing front panels 6*d, e* back to the position shown in FIG. 1.

Figure 2:
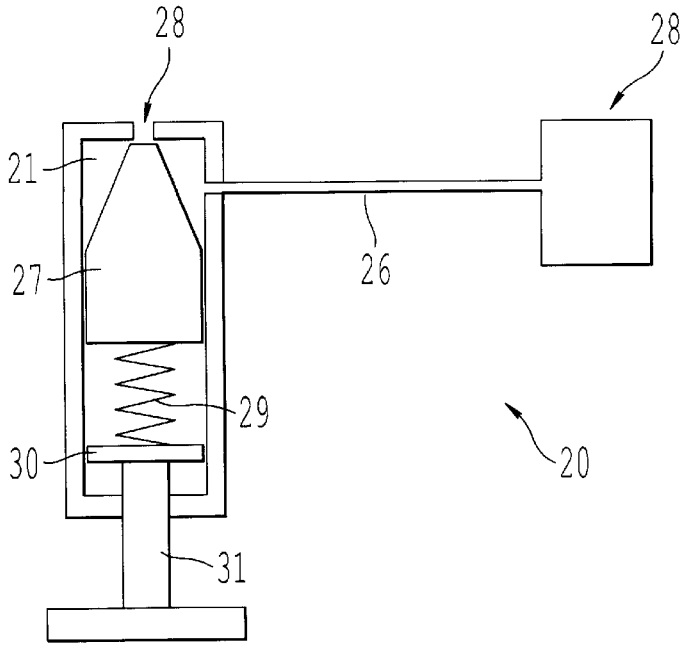
FIG. 2 shows a schematic cross-sectional view of the atomizer of the mist-bath unit.

According to FIG. 2, each atomizer 20 is provided with a hollow cylindrical compression space 21 having an aperture 28. Compression space 21 is in communication via a line 26 with a high-pressure pump 25, from which the liquid to be atomized is delivered. This contains water with a high concentration of salts dissolved therein, especially Dead Sea water, or an organic oil.

A conical piston 27 is disposed in compression space 21. Piston 27 is displaceable in the longitudinal direction of compression space 21 and, by means of a spring 29 at its rear end, is urged toward aperture 28 of compression space 21. Thus, in the position shown in FIG. 2, the tip of piston 27 seals aperture 28 of compression space 21.

Inside compression space 21, spring 29 extends in longitudinal direction between the rear end of piston 27 and a front end of a support plate 30. Support plate 30 is disposed at a front end of an adjusting screw 31 and, by turning adjusting screw 31, it can be displaced in compression space 21, in the longitudinal direction thereof. Thereby the spring force with which spring 29 presses the tip of piston 27 against aperture 28 of compression space 21 is adjustable.

During continuous delivery by high-pressure pump 25 of liquid to be atomized into compression space 21, this liquid is progressively further compressed in compression space 21. The pressure prevailing therein then rises to approximately 200 to 800 bar. Thereby an increasing force is exerted on piston 27 in the longitudinal direction of compression space 21, ultimately forcing it away from opening 28 of compression space 21, against the spring force exerted by spring 29.

Thereby, as shown in FIG. 3, the compressed liquid is released into the interior of tube 32. Since a normal atmosphere of approximately 1 bar prevails therein, the liquid then bursts apart explosively into minute mist particles. The mist then flows to an upper end of tube 32 and from there through a screen 33 into bathing cubicle 1. For this purpose, an upwardly directed suction effect is generated by fan 35, which is disposed underneath screen 33 at the upper end of tube 32. To the same extent that mist flows through screen 33 from tube 32 into bathing cubicle 1, make-up air can flow through supply-air apertures 36 provided at the lower end of tube 32 underneath compression spaces 21 of atomizers 20.

Figure 4:
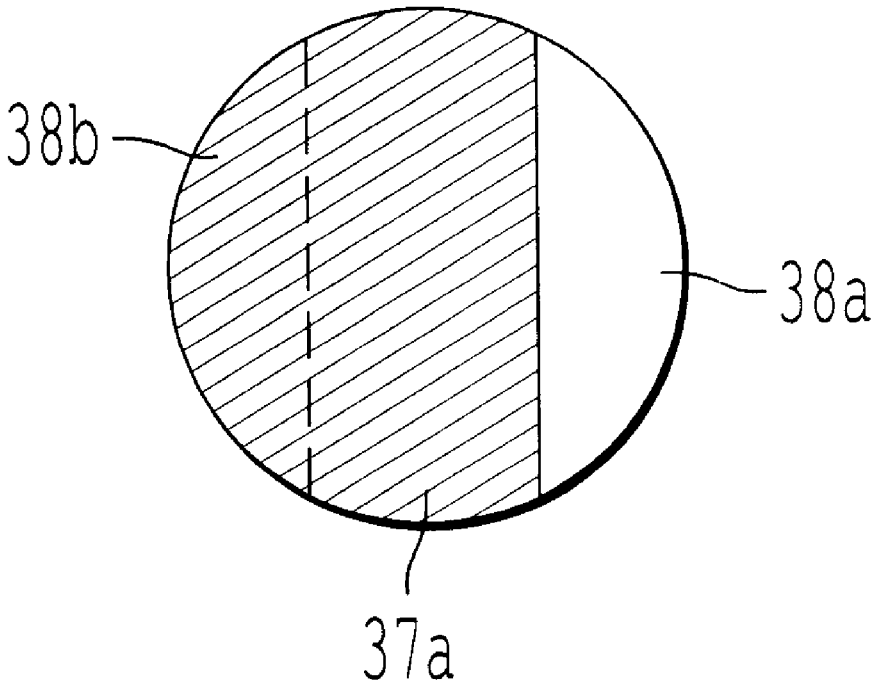
FIG. 4 shows a schematic sectional view of the tube of the mist-bath unit from above.

In tube 32, there are mounted upper sound absorber 34*a* between compression spaces 21 of atomizers 20 and screen 33 as well as lower sound absorber 34*b* underneath compression spaces 21 of atomizers 20, in order to absorb the sound waves produced when the liquid bursts apart explosively into small mist particles. Each sound absorber 34*a, b* comprises a plurality of sound-absorber plates 37*a, b*, which extend perpendicular to the axis of the tube, are spaced apart from one another and partly overlap one another. According to FIG. 4, each sound-absorber plate 37*a* provides, in the cross section of tube 32, an aperture 38*a* through which the mist particles can move upward in tube 32. As viewed from above, each sound-absorber plate 37*a* completely overlaps an aperture 38*b* (illustrated by a broken line in FIG. 4) provided by a sound-absorber plate 37*b* disposed therebelow or thereabove respectively.

The mist flowing through screen 33 from tube 32 as shown in FIG. 1 spreads out in bathing cubicle 1 and acts on the skin of the person occupying mist bath 2. In the process, the action of the mist on the skin is enhanced by the ultraviolet radiation emitted by UV source 8. After administration of the bath, the person can shower off with shower 9 before stepping out of bath cubicle 1, and thus remove oil or salt residues on the skin.

What is claimed is:

1. A full-body mist-bath unit having a bathing cubicle for accommodating at least one person and atomized liquid;

a liquid atomizer for preparation of the atomized liquid, which is provided with a high-pressure chamber in which the liquid is compressed by the action of a high pressure of at least 100 bar, and with a nozzle for explosive ejection of the compressed liquid subjected to high pressure, so that it bursts apart into small particles by virtue of its high internal pressure.

2. A unit according to claim 1, wherein the liquid to be atomized is water.

3. A unit according to claim 2, wherein salts are additionally mixed with the water.

4. A unit according to claim 1, wherein the liquid to be atomized is an organic oil.

5. A unit according to claim 1, wherein the bathing cubicle can be sealed such that it is airtight to the exterior.

6. A unit according to claim 1, wherein a UV source is provided in the bathing cubicle.

7. A unit according to claim 1, wherein a shower is provided in the bathing cubicle.

8. A unit according to claim 1, wherein a fan is provided in the bathing cubicle, especially in a tube of the bathing cubicle into which the liquid is ejected.

9. A method for administering a full-body mist bath to at least one person in a bathing cubicle, with the following steps compression of a liquid by the action of a high pressure of at least 100 bar on the liquid;

explosive ejection of the liquid, so that it bursts apart into small particles by virtue of its high internal pressure;

supplying the liquid burst apart into small particles to the bathing cubicle.

10. A method according to claim 9, wherein the liquid is water.

11. A method according to claim 9, wherein additional salts are mixed with the water.

12. A method according to claim 9, wherein the liquid is an organic oil.

13. A method according to claim 9, wherein the full-body mist bath is administered for 10 to 30 minutes.

14. A method according to claim 9, wherein between 0.01 and 0.5 ml of liquid is ejected in each case.

15. A method according to claim 9, wherein the liquid is ejected into a tube and supplied via the tube to the bathing cubicle.

* * * * *